US005681090A

United States Patent [19]

St. Thomas

[11] Patent Number: 5,681,090

[45] Date of Patent: Oct. 28, 1997

[54] MODULAR FURNITURE WITH POLYSTYRENE CORE

[76] Inventor: America St. Thomas, P.O. Box 75404, Honolulu, Hi. 96836

[21] Appl. No.: 614,832

[22] Filed: Mar. 8, 1996

[51] Int. Cl.[6] ..... A47C 7/00

[52] U.S. Cl. ..... 297/440.14; 297/452.17; 297/452.6; 297/DIG. 1; 297/228.13

[58] Field of Search ..... 297/440.14, 452.16, 297/452.17, 452.11, 452.58, 452.6, DIG. 1, 225, 218.3, 218.1, 228.13

[56] References Cited

U.S. PATENT DOCUMENTS

| | | | |
|---|---|---|---|
| 2,849,058 | 8/1958 | Bulleri et al. | 297/DIG. 1 X |
| 3,088,133 | 5/1963 | Waxman | 297/DIG. 1 X |
| 3,311,408 | 3/1967 | Sarvas | 297/218.3 |
| 3,566,423 | 3/1971 | Reinfeldt | 297/452.58 X |
| 3,619,879 | 11/1971 | Shirakawa | 297/DIG. 1 X |
| 3,642,323 | 2/1972 | Taylor | 297/DIG. 1 X |
| 3,722,950 | 3/1973 | Harnick | 297/218.1 |
| 3,740,774 | 6/1973 | Powell . | |
| 3,773,329 | 11/1973 | Secter . | |
| 3,811,728 | 5/1974 | Redemske . | |
| 3,904,242 | 9/1975 | Koepke et al. | 297/452.6 |
| 3,951,453 | 4/1976 | Zapf . | |
| 3,967,852 | 7/1976 | Eiselt et al. . | |
| 3,973,281 | 8/1976 | Davis et al. . | |
| 3,989,300 | 11/1976 | Heumann | 297/218.3 X |
| 4,073,539 | 2/1978 | Caruso | 297/DIG. 1 X |
| 4,191,424 | 3/1980 | Mundell . | |
| 4,437,704 | 3/1984 | Hovsepians . | |
| 4,691,963 | 9/1987 | Mikuniya et al. | 297/452.6 X |
| 4,840,430 | 6/1989 | Shimada | 297/DIG. 1 X |
| 5,236,243 | 8/1993 | Reyes | 297/219.1 |
| 5,277,476 | 1/1994 | Caldwell | 297/218.3 X |
| 5,318,348 | 6/1994 | Hess | 297/440.11 |
| 5,385,385 | 1/1995 | Silverman | 297/250.1 |
| 5,543,213 | 8/1996 | Duvenkamp | 297/DIG. 1 X |

FOREIGN PATENT DOCUMENTS

| | | | |
|---|---|---|---|
| 138724 | 4/1985 | European Pat. Off. | 297/218.1 |
| 168240 | 1/1986 | European Pat. Off. | 297/228.13 |
| 96181 | 5/1972 | France | 297/DIG. 1 |
| 2225119 | 11/1974 | France | 297/DIG. 1 |
| 2252701 | 5/1974 | Germany | 297/DIG. 1 |
| 7809666 | 3/1979 | Netherlands | 297/DIG. 1 |
| 2150021 | 6/1985 | United Kingdom | 297/452.11 |

OTHER PUBLICATIONS

Popular Science, "All–Foam Furniture", Dow Chemical, p. 108, Nov. 1972.

*Primary Examiner*—Peter M. Cuomo
*Assistant Examiner*—David E. Allred
*Attorney, Agent, or Firm*—Robert Carson Godbey

[57] ABSTRACT

A new and improved modular furniture design using a solid block of expanded polystyrene as a core for the furniture. This improved design combines the structural rigidity of a solid core with the light weight of plastic foam construction.

2 Claims, 3 Drawing Sheets

MODULAR FURNITURE WITH POLYSTYRENE CORE

BACKGROUND OF THE INVENTION

The present invention relates generally to modular furniture and, more particularly, to a new and improved modular furniture design using expanded polystyrene as a core for the furniture.

DESCRIPTION OF THE RELATED ART

Traditional upholstered furniture designs have utilized wood or metal frames to provide stability and rigidity to the furniture shape. These traditional designs are durable but generally heavy and difficult to move or combine into modular furniture groupings.

Light weight modular furniture is well known in the related art, but generally has used a solid core of foamed polyurethane or polyethylene, with a fabric cover. This creates a light weight furniture design, but without the structure and rigidity provided by the traditional upholstered furniture design utilizing a wood or metal frame. There is the further disadvantage that foamed polyurethane or polyethylene used in this manner, without other support, tends to break down or degrade over a relatively short period of years.

The inventor is unaware of any present furniture art that combines the structural rigidity of a solid core with the light Weight of polystyrene and plastic foam construction.

The present invention is an innovation in modular furniture art that allows the benefits of a rigid core of polystyrene, providing benefits similar to that of a frame of wood or metal as in traditional furniture; and the light weight of polystyrene and foam construction suitable for modular furniture.

SUMMARY OF THE INVENTION

In view of the failure of the prior art to provide the benefits of the structural rigidity of a solid core with the light weight of plastic foam construction, the object of the present invention is to provide improved modular furniture incorporating a rigid polystyrene core covered by comfortable fire-proofed highly resilient foam padding on the back, seat, and arms of the furniture.

A further object of the present invention is to provide a novel assembly of light weight modular furniture constructed and adapted to allow easy rearrangement of furniture pieces, typical of modular furniture design, due to the light weight of the furniture.

It is a further object of the invention to utilize commercially available block polystyrene to provide such a light weight base, which allows economical and efficient construction of the modular furniture. The durability of the block polystyrene base is enhanced because it is entirely covered by a fabric cover or other foam materials, which aids in the prevention of degradation of the polystyrene by ultraviolet light or friction against the surface of the polystyrene.

A further object of the present invention is to provide a furniture design incorporating an easily removable fabric cover that will allow the cover to be easily cleaned and maintained, or replaced with a new design or color, thus encouraging reuse of the polystyrene and foam core of the furniture.

Still further objects and advantages will become apparent from a consideration of the ensuing description and drawings.

BRIEF DESCRIPTION OF THE DRAWINGS

The features of the invention are set out in the following, with specific reference to the accompanying drawings, in which like reference numbers indicate corresponding parts throughout the several figures.

FIG. 2 is a top view of same representative modular furniture group indicating where sections would be taken from;

DESCRIPTION

Figure 1:
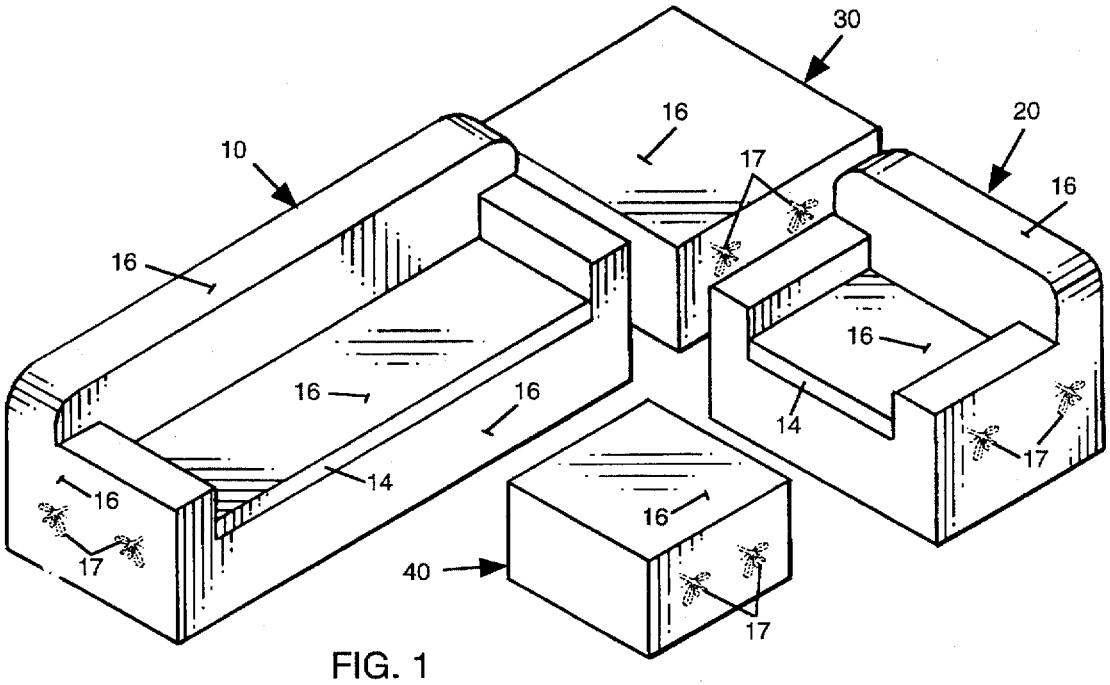
FIG. 1 is a perspective view of a plurality of modular furniture elements including a representative couch, chair, cube table, and foot stool, and forming a representative modular furniture group.

Referring initially to FIG. 1, a modular furniture group is shown in representative form, including a couch assembly 10 shown in representative form, a chair assembly 20 shown in representative form, an end cube assembly 30 shown in representative form, and a foot stool assembly 40 shown in representative form.

Figure 2:
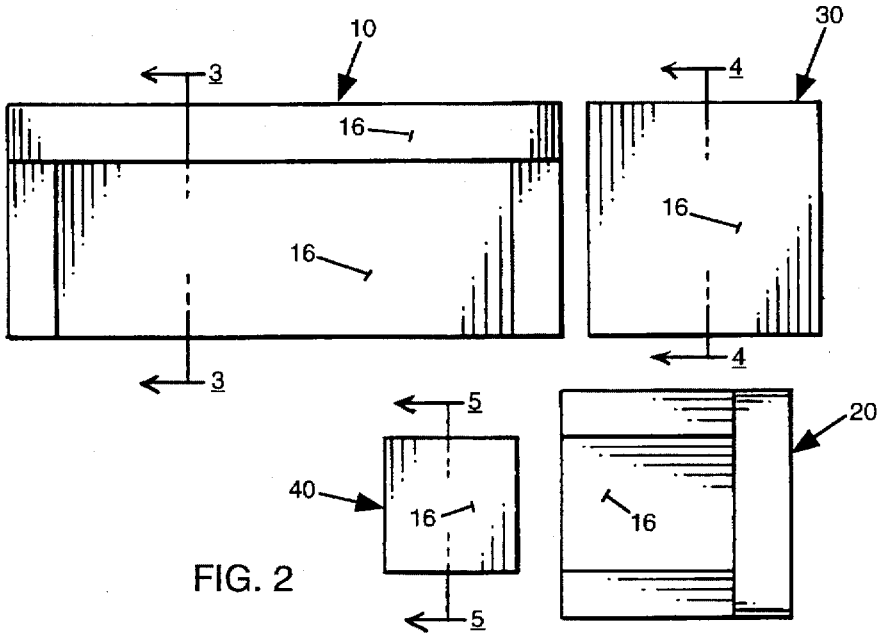
Figure 3:
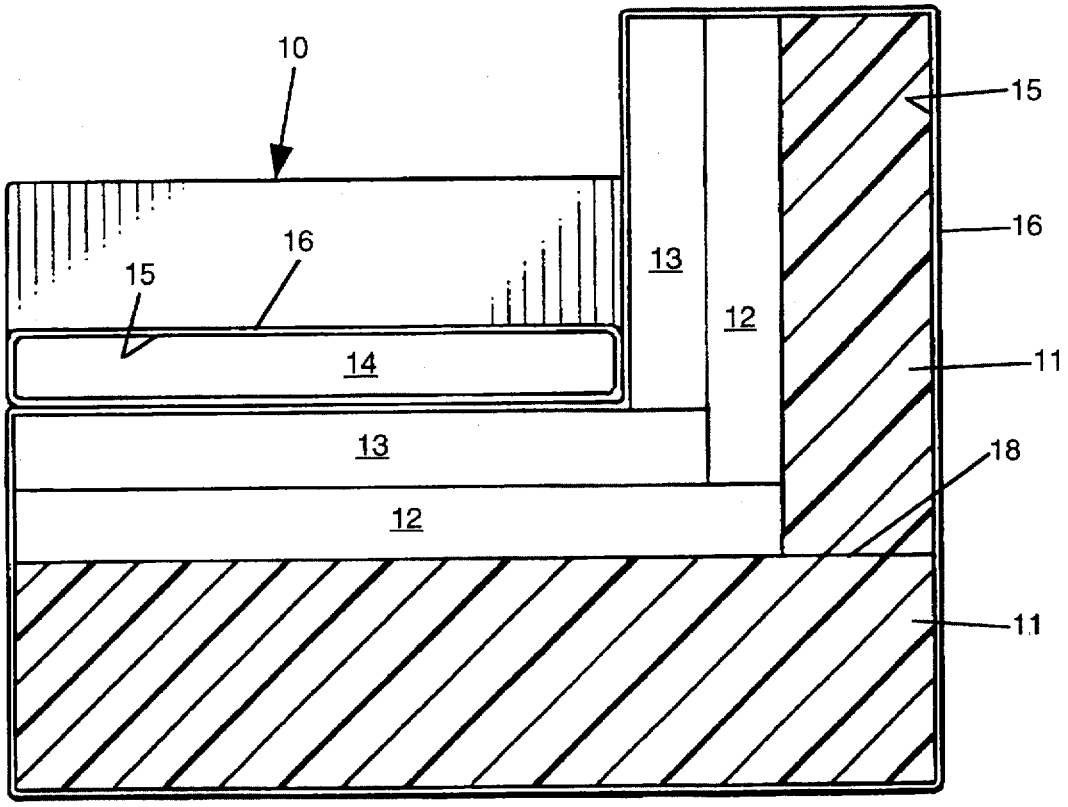
FIG. 3 is an enlarged section view of a couch (chair would be same)
Figure 4:
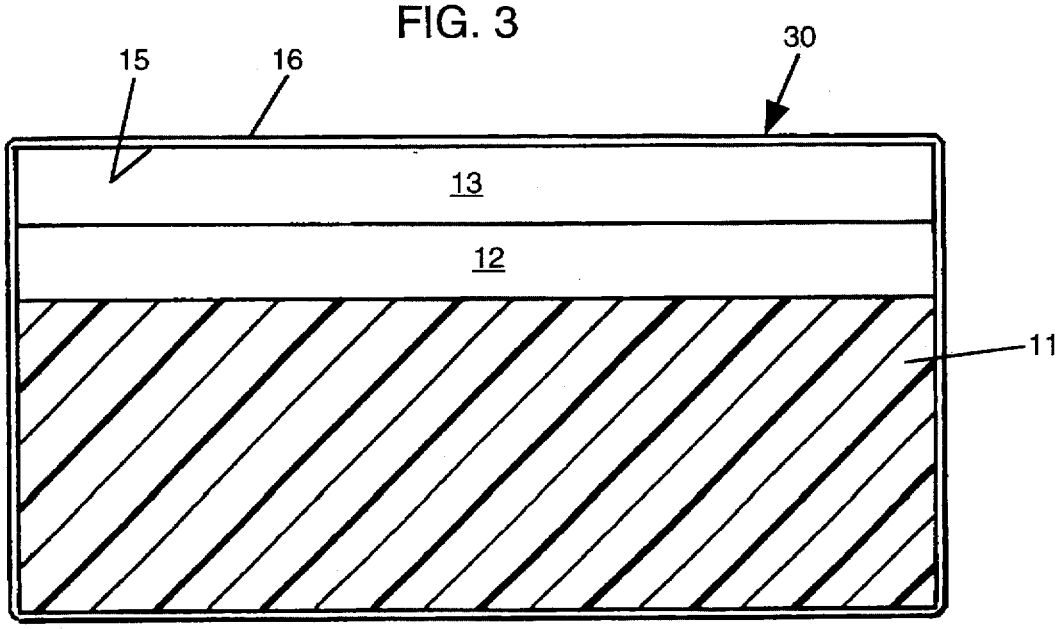
FIG. 4 is an enlarged section view of a cube table.
Figure 5:
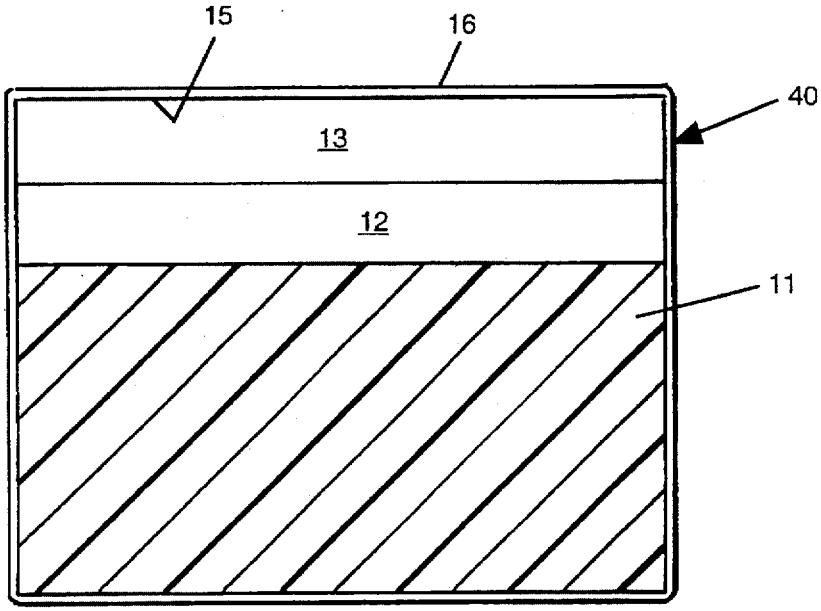
FIG. 5 is a section view of a foot stool.

Referring additionally to FIG. 2, a top view of the representative modular furniture group is shown indicating where sectional views will be taken from. A sectional view of the representative couch assembly is shown in FIG. 3. A sectional view of the chair assembly would be substantially similar. A sectional view of the representative cube table is shown in FIG. 4, and a sectional view of the representative foot stool is shown in FIG. 5.

Referring to FIG. 3, it will be seen that in the representative furniture assemblies there is a base material of polystyrene, 11. In the preferred embodiment of this invention, the polystyrene base material is an expanded polystyrene thermoplastic (ethenylbenzene homopolymer), with a specific gravity of 0.6 pcf to 2.0 pcf, commonly known as "beadboard." The polystyrene has the desirable characteristics of being light weight and rigid. This product is available commercially in rigid cellular foam blocks, boards, and shapes. An advantage of this invention is that such commercially available block-form polystyrene can be cut to the shape of the furniture base. This minimizes expense, because custom molding of the polystyrene is not required. Accordingly, the furniture can be economically manufactured even in small quantities or in custom configurations. Arm and back blocks of polystyrene are attached by adhesive means, 18, to the base block.

Referring further to FIG. 3, it will be seen that in the preferred embodiment a 3" layer of dense bonded polyurethane foam, 12, is attached by adhesive means to the polystyrene base. A 3" layer of high quality poured polyurethane foam, 13, is attached by adhesive means to the bonded polyurethane foam, 12. In the preferred embodiment a removable cushion of upholstered high quality poured polyurethane foam, 14, rests in the seating area of the chair and sofa. In the preferred embodiment these layered foams of varying character provide durable seating support of increasing density.

Any material that provides a force, or "fight back," when subjected to indentation by a load can qualify as a cushion.

As the force or load on a cushion increases, the indentation increases as a result of the load pressing further into the cushion. Polyurethane foam provides excellent cushioning, and has the desirable properties of relatively low cost, comfort, ease of fabrication, density, and durability. By the beginning of the 1980's, polyurethane foam had captured about 90% of all cushioning applications. See Hilyard, N. C., *Mechanics of Cellular Plastics,* at 100–101, 106–107. (MacMillan, New York). If a cushion provides an initial "fight back" but then allows an individual to settle rapidly into the cushion,. the individual will "bottom out." This phenomena is undesirable in a foam cushion. Id. at 101. At the other extreme, polystyrene, while providing structural rigidity, provides little cushioning. In the preferred embodiment of this invention, the layers of polyurethane foam over the block polystyrene provide appropriate cushioning of increasing firmness and the structural rigidity of a rigid base.

A cloth lining, 15, completely encloses the foam interior of the assembly. In the preferred embodiment, the cloth lining is of cotton, or cotton-polyester blend, muslin. A cover fabric, 16, encloses the entire assembly. Thus the polystyrene block base material is completely covered. This has two advantages. It minimizes the degradation of the polystyrene from ultraviolet light. Also, it protects the surface of the polystyrene, which otherwise has a tendency to degrade as the bead-like elements of the surface of the polystyrene are worn away from contact and friction.

In the preferred embodiment a zipper allows the cover fabric to be removed for cleaning, or replacement, should a new color or design of cover fabric be desired. In the preferred embodiment the fabric used is a durable all-weather acrylic, such as that used for exterior purposes, such as awnings and boats. One such commercial product is SUNBRELA by Glen Raven Mills, Inc.

Figure 6:
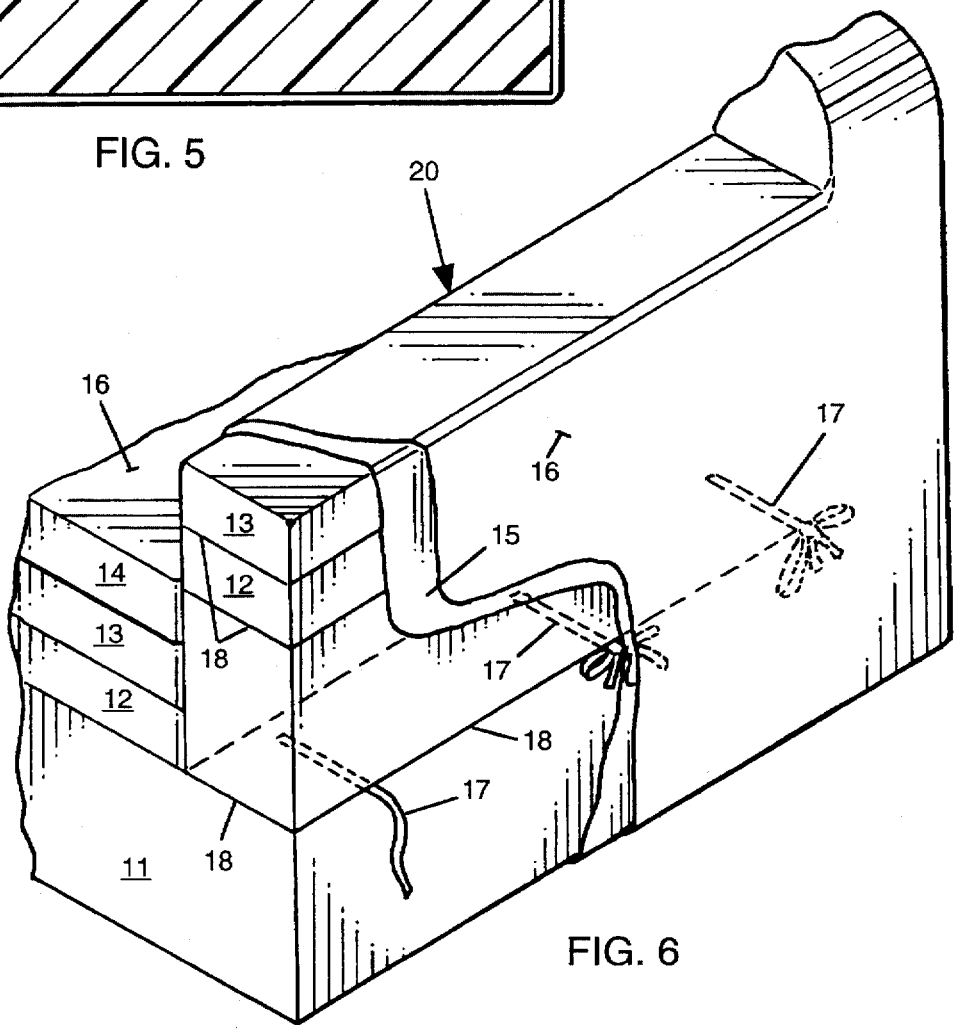
FIG. 6 is an enlarged perspective section showing detail of attaching fabric lining and cover.

Referring to FIG. 3, it will be seen that in the representative couch and chair, sections of block polystyrene beadboard are attached by adhesive means, 18, to the block polystyrene base, to form the back and sides of the unit. Referring to FIG. 6, in the preferred embodiment cotton tabs or strips 17 are inserted between the blocks and thus adhesively held to the polystyrene core. These tabs or strips to similar tabs or strips 17 sewn into the cloth lining 15. The tabs thus hold the cloth lining and fabric cover firmly to the foam base of the furniture. It is difficult and important to hold the cloth lining and the fabric cover to the foam base, particularly in the seating area of the chair and couch. The surface of the base unit tends to allow movement of the fabric. Experimentation has shown this to be the most effective means for holding the cloth lining to the foam base. The fabric cover is then secured to the cloth lining by any of numerous well known means.

Although the description above contains many specificities, these should not be construed as limiting the scope of the invention, but as merely providing illustrations of some of the presently preferred embodiments of this invention. Thus the scope of the invention should be determined by the appended claims and their legal equivalents, rather than by the examples given.

What is claimed is:

1. Modular styled furniture suitable for combining multiple modules into a plurality of furniture combinations, each module comprising:

(a) a foam base including:

(i) a polystyrene block core formed of a plurality of blocks wherein said polystyrene block core has a specific gravity of 0.6 pcf to 2.0 pcf;

(ii) a dense foam intermediate layer bonded by adhesive means to a seating surface of said polystyrene block core;

(iii) a poured foam upper layer bonded to said dense foam intermediate layer by adhesive means;

(b) a cloth lining having strips attached thereto and covering said foam base;

(c) cotton strips having first ends inserted between said plurality of blocks and secured by adhesive means to said polystyrene block core and second ends tied to said tabs of said cloth lining, whereby said cloth lining is held firmly to said foam base;

(d) a fabric upholstery material covering each module.

2. Modular styled furniture according to claim 1, wherein said fabric upholstery material is acrylic.

* * * * *